US010189615B2

(12) United States Patent
Martin et al.

(10) Patent No.: US 10,189,615 B2
(45) Date of Patent: Jan. 29, 2019

(54) CHILD-RESISTANT CANISTER

(71) Applicant: Berry Plastics Corporation, Evansville, IN (US)

(72) Inventors: Brian Martin, New Providence, PA (US); John A. Vassallo, Lititz, PA (US)

(73) Assignee: Berry Plastics Corporation, Evansville, IN (US)

( * ) Notice: Subject to any disclaimer, the term of this patent is extended or adjusted under 35 U.S.C. 154(b) by 105 days.

(21) Appl. No.: 15/299,676

(22) Filed: Oct. 21, 2016

(65) Prior Publication Data

US 2017/0113851 A1 Apr. 27, 2017

Related U.S. Application Data

(60) Provisional application No. 62/244,373, filed on Oct. 21, 2015.

(51) Int. Cl.
*B65D 50/04* (2006.01)
*B65D 43/02* (2006.01)

(52) U.S. Cl.
CPC ..... *B65D 50/043* (2013.01); *B65D 43/0225* (2013.01); *B65D 50/046* (2013.01)

(58) Field of Classification Search
CPC . B65D 50/043; B65D 43/0225; B65D 50/046
USPC ..... 215/216
See application file for complete search history.

(56) References Cited

U.S. PATENT DOCUMENTS 4,948,002 A * 8/1990 Thornock ..... B65D 50/046 215/216
5,706,963 A * 1/1998 Gargione ..... B65D 50/046 215/217
2006/0108312 A1* 5/2006 Robinson ..... B65D 50/046 215/216

* cited by examiner

*Primary Examiner* — James N Smalley
(74) *Attorney, Agent, or Firm* — Barnes & Thornburg LLP

(57) ABSTRACT

A child-resistant canister includes a container and a closure configured to mount on the container to close an opening into an interior region formed in the container. The closure includes a lid and a lid anchor coupled to the lid. The lid anchor is configured to mate with a closure retainer included in the container to retain the closure in a mounted position on the container.

16 Claims, 7 Drawing Sheets

CHILD-RESISTANT CANISTER

CROSS REFERENCE TO RELATED APPLICATIONS

This application claims priority under 35 U.S.C. § 119(e) to U.S. Provisional Patent Application No. 62/244,373, filed Oct. 21, 2015, which is expressly incorporated by reference herein.

BACKGROUND

The present disclosure relates to a canister, and particularly to a canister including a container and a removable closure. More particularly, the present disclosure relates to a child-resistant canister.

SUMMARY

According to the present disclosure, a child-resistant canister includes a container and a closure configured to mount on the container to close an opening into product-receiving chamber formed in the container. The closure includes a lid and a lid anchor coupled to the lid. The lid anchor is configured to mate with a closure retainer included in the container to retain the closure in a mounted position on the container.

In illustrative embodiments, the child-resistant canister further includes a closure-release control mechanism. The closure-release control mechanism includes a first lock tab coupled to the lid and a companion stationary tab blocker coupled to the container. A passageway is formed through the lid and lid anchor to allow movement of the lock tab relative to the tab blocker to remove the lock tab from engagement with the tab blocker at the selection of a user and allow removal of the closure from the container.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

A child-resistant canister 10 in accordance with the present disclosure provides for maximized filling speed while minimizing a short and squatty appearance of child-resistant canister 10. Child-resistant canister 10 accomplishes this by maximizing the ID of the container while minimizing the OD1 of the closure. Thus, the competing interests of filling speed and appearance of child-resistant canister 10 are satisfied. Passageways 27, 29 formed in a closure of child-resistant canister 10 minimize weight of closure 16 while allowing the OD1 of closure 16 to be minimized such that smaller bottle footprints can be used without overhang of closure 16.

Figure 1:
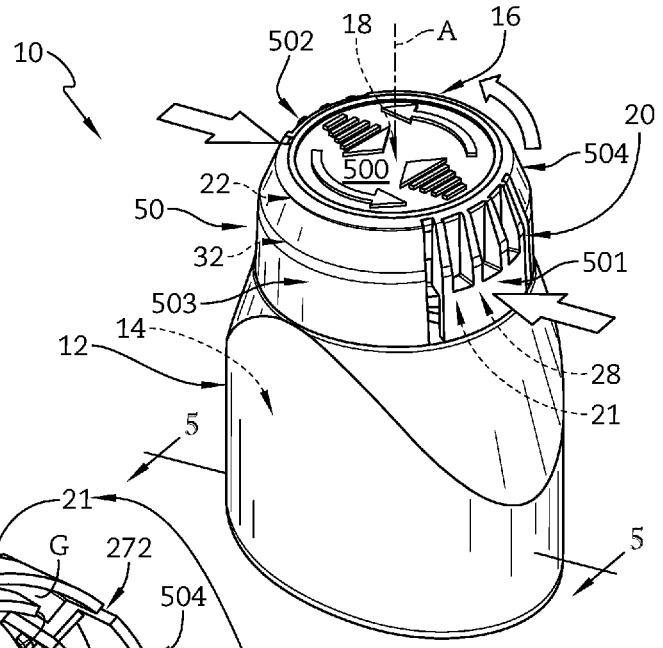
FIG. 1 is a perspective view of a child-resistant canister in accordance with the present disclosure showing a closure mounted on an underlying container and suggesting that an adult user may apply a squeezing force (solid double arrows) to opposite sides of the closure to engage a child-resistant closure-release control mechanism provided in the canister so that the closure is free to rotate in a counterclockwise closure-removal direction from a closed position shown in FIGS. 1 and 5 toward an opened position in a manner suggested, for example, in FIGS. 13-14.
Figure 5:
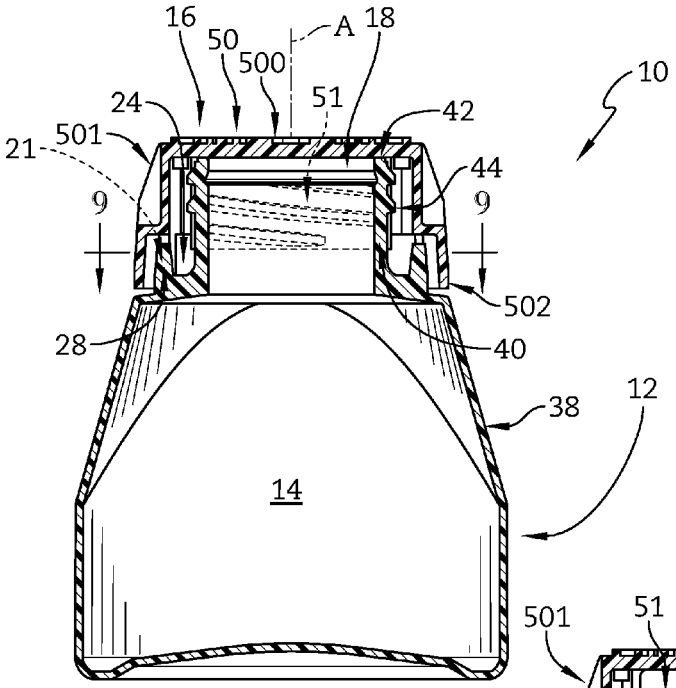
FIG. 5 is a sectional view taken along line 5-5 in FIG. 1 showing the closure coupled on the container and suggesting that the second lid anchor (positioned behind the filler neck) engages with the closure retainer to hold the closure on the container such that the top wall covers the opening into the product-receiving chamber.

Child-resistant canister 10 includes a container 12 formed to include a product-receiving chamber 14 and removable closure 16 configured to mount on top of container 12 and cover an opening 18 formed in container 12 as suggested in FIGS. 1 and 5. Child-resistant canister 10 further includes a child-resistant closure-release control mechanism 20 comprising a first lock tab 21 coupled to closure 16 and a companion first tab blocker 28 coupled to container 12 and configured to mate with first lock tab 21 as suggested in FIGS. 2 and 8. Canister 10 may have any suitable shape, such as cylindrical, circular, round, square, polygonal, or any other suitable alternative.

During installation of closure 16 on container 12, as suggested in FIGS. 9-12, closure 16 is rotated about axis of rotation A in a clockwise closure-installation direction relative to the underlying container 12 and first lock tab 21 of closure-release control mechanism 20 is moved into a lock-tab pass-through channel 24 formed between first tab blocker 28 of closure-release control mechanism 20 and a filler neck 40 of container 12. Stationary tab blocker 28 is arranged to block normal rotation of closure 16 in a counterclockwise closure-removal direction about axis A relative to container 12 as suggested in FIGS. 8 and 12. In some embodiments, the closure-installation direction is counterclockwise while the closure-removal direction is clockwise.

Figure 13:
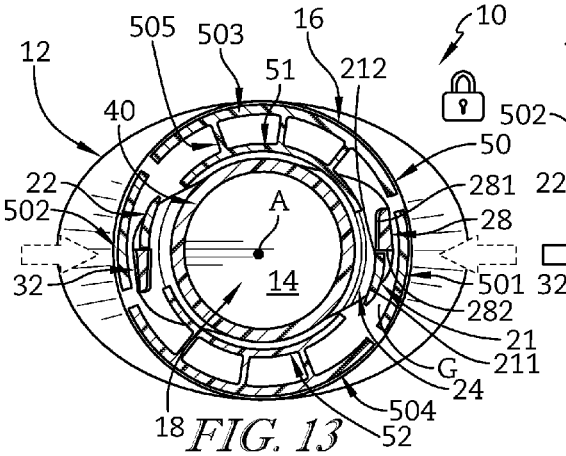
FIGS. 13 and 14 are a series of views showing movement of the lock tabs relative to the companion triangle-shaped tab blockers during removal of the closure from the container.
Figure 14:
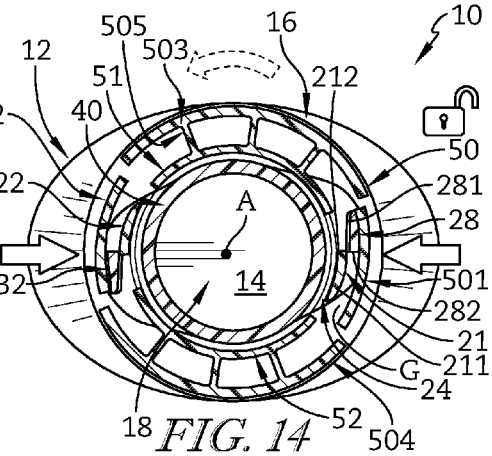

First lock tab 21 is moved in a radially inward direction toward axis A to separate first lock tab 21 from stationary tab blocker 28 when an adult applies squeezing forces to closure 16 as suggested in FIGS. 1, 7-8, and 13-14 to initiate removal of closure 16 from container 12. Once first lock tab 21 is separated from stationary tab blocker 28 as shown in FIG. 14, closure 16 is free to rotate about axis A in a counterclockwise closure-removal direction when the adult applies an input force, such as twisting forces (i.e., torque), for example, to closure 16 in an effort to remove closure 16 from container 12. A passageway 27 formed in closure 16 allows lock tab 21 to be disengaged from tab blocker 28 while minimizing an overall outer diameter (OD) of closure 16 for a given inner diameter (ID) associated with filler neck 40.

Figure 2:
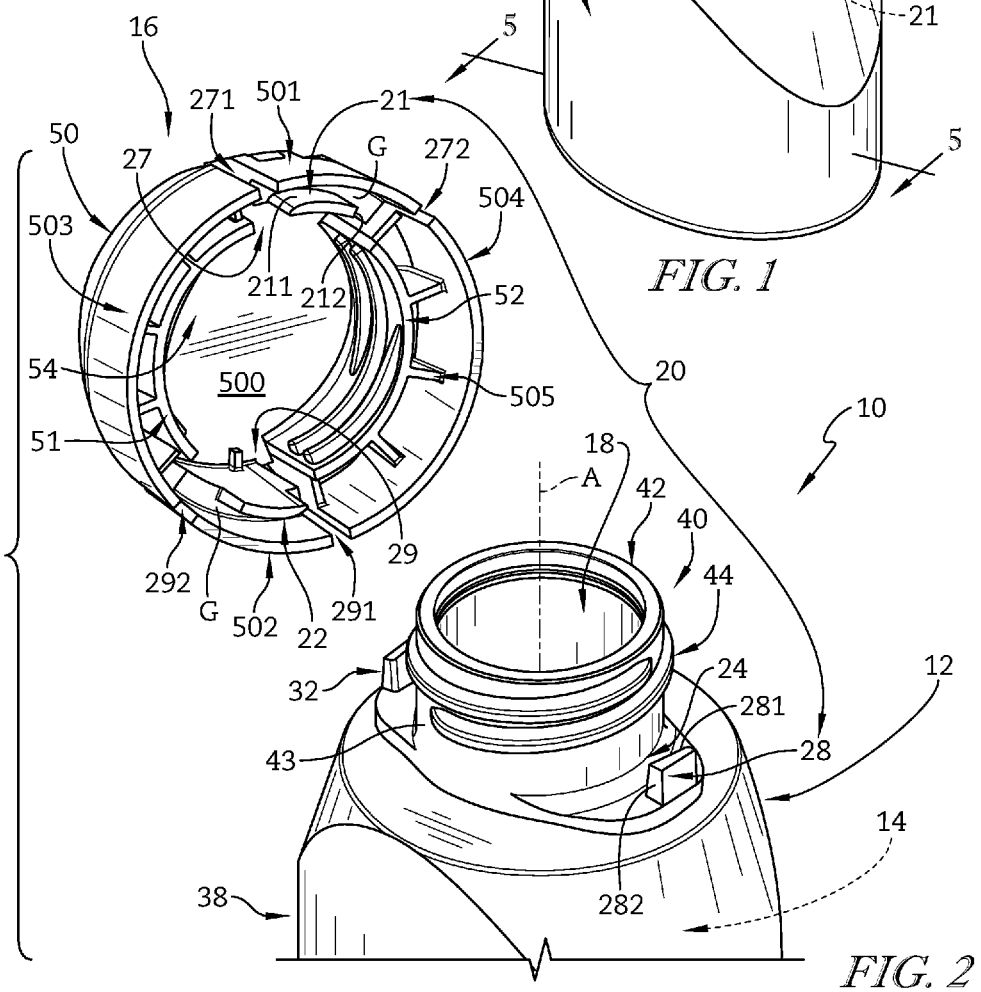
FIG. 2 is an enlarged partial perspective view of the canister of FIG. 1 showing the closure prior to installation on the container and showing one of the upwardly extending triangle-shaped tab blockers included in the closure-release control mechanism and suggesting that one of the two long downwardly extending lock tabs included in the closure-release control mechanism is arranged to mate with its companion triangle-shaped tab blocker when the closure is mounted on the container in the manner suggested in FIGS. 8-12 to lock the closure to the container so that closure resists opening by a child.

Container 12 includes a body 38 and filler neck 40 coupled to body 38 as shown, for example, in FIG. 2. Filler neck 40 is formed to include open mouth 18 (also called opening 18) arranged to open into product-receiving chamber 14 formed in body 38 as suggested in FIG. 2. Filler neck 40 includes a rim 42 coupled to body 38 and a closure retainer 44 coupled to rim 42 and configured to mate with closure 16 to retain closure 16 in an installed position on container 12 as suggested in FIG. 5. In one example, rim 42 is cylindrical, but rim 42 may be any other suitable shape.

Closure retainer 44 is coupled to exterior surface 43 of filler neck 40 as shown in FIG. 2. In this illustrative embodiment, closure retainer 44 comprises one or more thread segments that are configured to engage corresponding threads or thread segments on closure 16. In another example, closure 16 may include any other suitable closure mechanisms such as, but not limited to, cams, bayonet style closures elements, or any other suitable alternative or combination.

In some embodiments, closure retainer 44 comprises one or more slots for receiving one or more keys of the closure. In some embodiments, closure retainer 44 comprises one or more camways for receiving one or more cams of the closure. Closure retainer 44 and rim 42 cooperate to form a monolithic, one piece, or unitary element in the illustrated embodiment. In some embodiments, closure 16 is mounted on container 12 through rotation of closure 16 relative to container 12. Closure 16 may be dismounted from container 12 using a reverse rotation. In some embodiments, an axial, linear, transverse, or sliding movement may be used alternatively to or in combination with rotation to mount closure 16 on container 12. Closure 16 may be dismounted from container 12 using a reverse movement or combination of movements.

Figure 3:
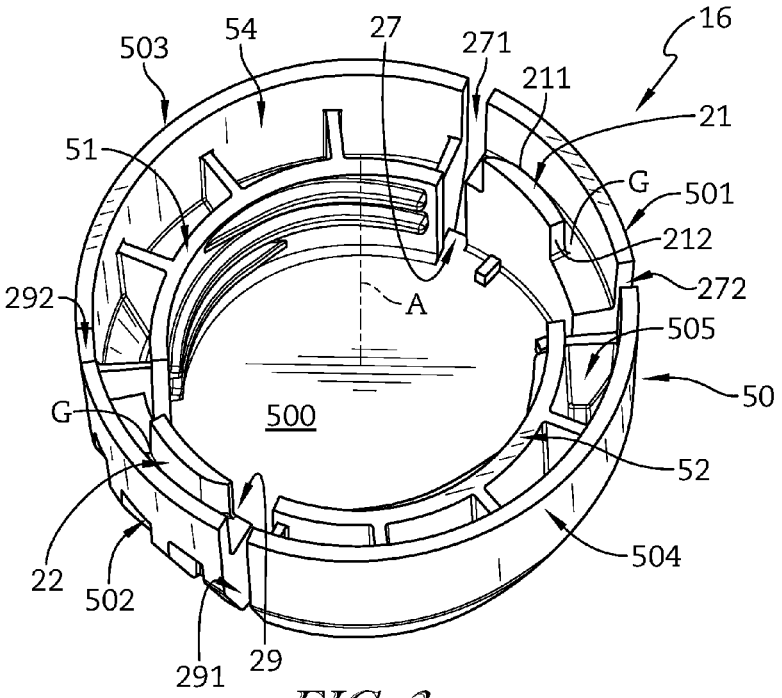
FIG. 3 is an enlarged perspective view of an underside of the closure of FIGS. 1 and 2 showing that the closure includes a lid comprising a top wall, two side walls coupled to the top wall and separated by passageways, two shorter tab-mover walls coupled to the top wall and located within the passageways, a first lock tab included in the closure-release control mechanism is coupled to the tab-mover wall in an upper-right portion of FIG. 3, and a second lock tab included in the closure-release control mechanism is coupled to the tab-mover wall in a lower-left portion of FIG. 3 and showing that the closure further includes a first lid anchor and a second lid anchor which are also separated by the passageways.
Figure 4:
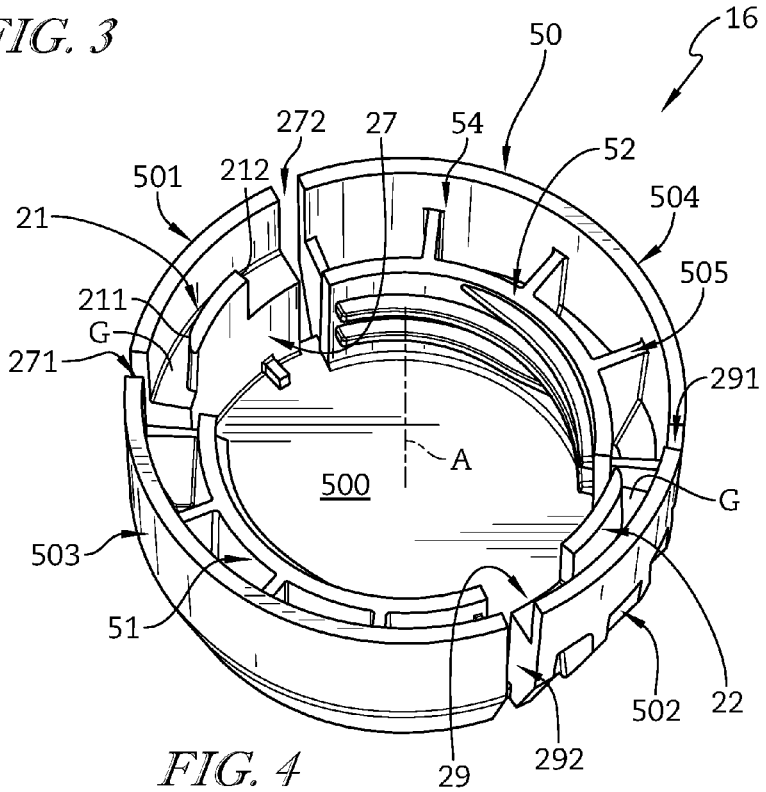
FIG. 4 is a view similar to FIG. 3 with the closure rotated counterclockwise showing that slots are formed between the tab-mover walls and the side walls of the closure to allow movement of the tab-mover walls relative to the side walls within the passageways.

Closure 16 includes a lid 50, a first lid anchor 51, and a second lid anchor 52 as shown, for example, in FIGS. 2-4. First lock tab 21 is coupled to lid 50 and arranged to lie in an interior region 54 formed in lid 50 as suggested in FIGS. 2-4. First lid anchor 51 is configured to mate with companion closure retainer 44 during installation of closure 16 on container 12 as suggested in FIGS. 2 and 5-7 to retain lid 50 in a mounted position on filler neck 40 closing open mouth 18 of container 12. Second lid anchor 52 is also configured to mate with closure retainer 44. In some embodiments, a liner is positioned to lie along a top wall 500 between first and second lid anchors 51, 52 to assist in sealing against rim 42 of container 12 to cover open mouth 18.

Figure 15:
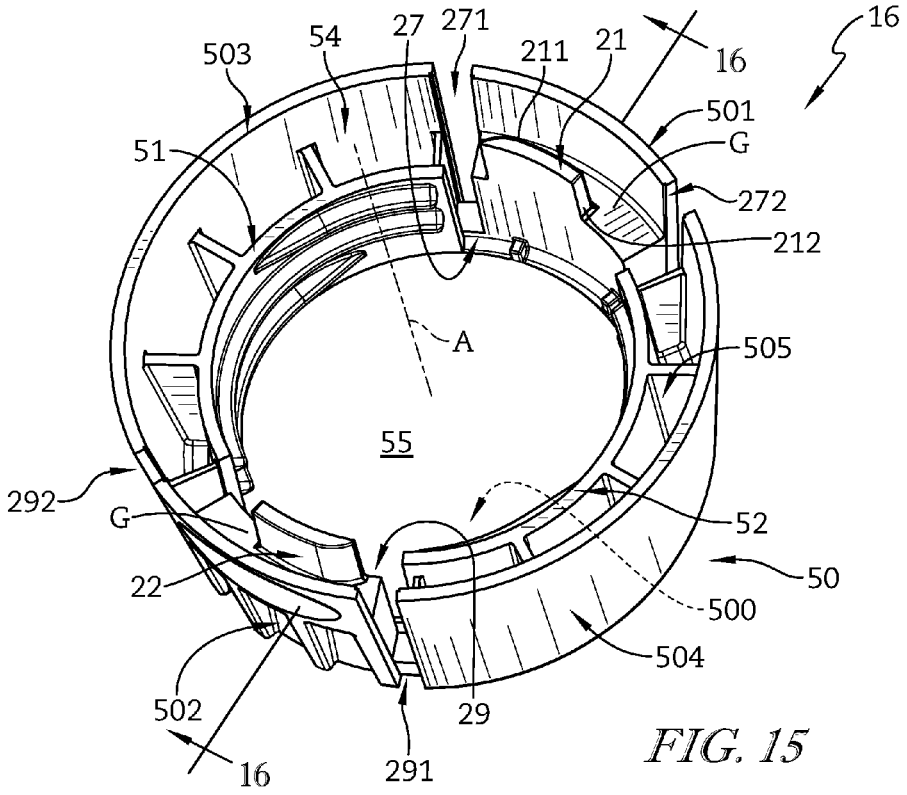
FIG. 15 is a view similar to FIG. 3 showing a liner positioned to lie along a top wall of the closure.
Figure 16:
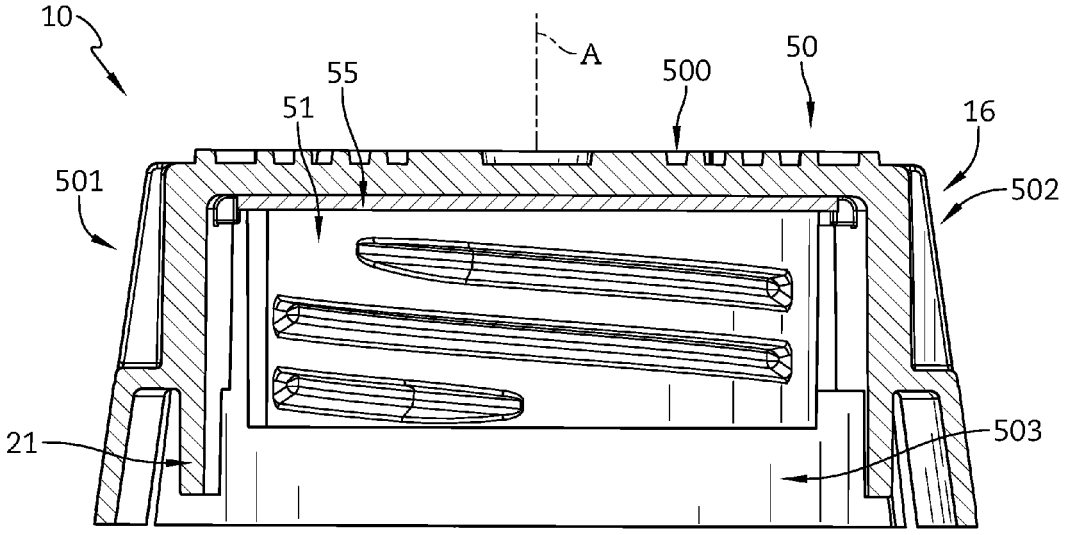
FIG. 16 is a sectional view taken along line 16-16 in FIG. 15.

In some embodiments, an oversized, floating (non-glued) liner 55 is positioned to lie along top wall 500 as shown in FIGS. 15 and 16. The thread segments of lid anchors 51, 52 terminate before reaching top wall 500, as shown by lid anchor 51. This allows the thread segments of anchors 51, 52 to act as an undercut or mechanical stop for liner 55 once liner 55 is positioned to lie along top wall 500 between the end of the thread segments and top wall 500. Liner 55 can be oversized relative to opening 18 of filler neck 40 which allows the placement of liner 55 to vary relative to filler neck 40 while still forming a seal with rim 42.

Lid 50 includes top wall 500 and first and second tab-mover walls 501, 502 coupled to top wall 500 and arranged to lie in spaced-apart relation to one another as shown in FIGS. 2-4 and 7. Lid 50 also includes two side walls 503, 504 coupled to top wall 500 and arranged to lie in spaced-apart relation to one another. In the illustrated embodiment, lid anchors 51, 52 are positioned to lie radially inward of side walls 503, 504, respectively. A plurality of optional stabilizer webs 505 extend between respective lid anchors 51, 52 and side walls 503, 504 as suggested in FIGS. 3 and 4.

Side walls 503, 504 define an outer diameter (OD) of closure 16 as measured from a lower perimeter edge of side walls 503, 504 spaced apart from top wall 500. First and second lid anchors 51, 52 define an inner diameter (ID) of closure 16 corresponding in size with rim 42 of container 12 to allow engagement of first and second lid anchors 51, 52 with closure retainer 44.

Table 1 shows several examples of dimensions for closures in accordance with the present disclosure. Closure size is measured in millimeters and measures an opening diameter (AD) of an opening formed in the container through which the filler neck passes as suggested in FIG. 7. The inner diameter (ID) is measured in inches and may also be called the "E" dimension when referring to container neck measurements as suggested in FIG. 7. The outer diameter (OD) is measured in inches and refers to a maximum diameter of the closure as suggested in FIG. 7. Closures in accordance with the present disclosure may use any value shown by the ranges below in Table 1, any point within the ranges, or any combination of ranges falling within the range shown below in Table 1.

TABLE 1

| Inner Diameter (ID) for Various Container Sizes | | | | |
|---|---|---|---|---|
| Closure Size (AD) (mm) | Neck Inner Diameter (ID) Max (inches) | Neck Inner Diameter (ID) Min (inches) | Neck Outer Diameter (OD) Max (inches) | Neck Outer Diameter (OD) Min (inches) |
| 18 | 0.635 | 0.621 | 1.197 | 1.183 |
| 20 | 0.714 | 0.700 | 1.276 | 1.262 |
| 22 | 0.793 | 0.779 | 1.355 | 1.341 |
| 24 | 0.871 | 0.857 | 1.433 | 1.419 |
| 28 | 1.009 | 0.995 | 1.571 | 1.557 |
| 30 | 1.048 | 1.034 | 1.610 | 1.596 |
| 33 | 1.186 | 1.172 | 1.748 | 1.734 |
| 35 | 1.285 | 1.271 | 1.847 | 1.833 |
| 38 | 1.397 | 1.383 | 1.959 | 1.945 |
| 40 | 1.501 | 1.487 | 2.063 | 2.049 |
| 43 | 1.575 | 1.561 | 2.137 | 2.123 |
| 45 | 1.691 | 1.647 | 2.253 | 2.209 |
| 48 | 1.791 | 1.777 | 2.353 | 2.339 |
| 51 | 1.889 | 1.875 | 2.451 | 2.437 |
| 53 | 1.988 | 1.974 | 2.550 | 2.536 |
| 58 | 2.145 | 2.131 | 2.707 | 2.693 |
| 60 | 2.263 | 2.249 | 2.825 | 2.811 |
| 63 | 2.382 | 2.368 | 2.944 | 2.930 |
| 66 | 2.500 | 2.486 | 3.062 | 3.048 |
| 70 | 2.657 | 2.643 | 3.219 | 3.205 |
| 75 | 2.834 | 2.820 | 3.396 | 3.382 |
| 77 | 2.956 | 2.942 | 3.518 | 3.504 |
| 83 | 3.165 | 3.149 | 3.727 | 3.711 |
| 89 | 3.408 | 3.392 | 3.970 | 3.954 |
| 100 | 3.836 | 3.818 | 4.398 | 4.380 |
| 110 | 4.230 | 4.212 | 4.792 | 4.774 |
| 120 | 4.625 | 4.605 | 5.187 | 5.167 |

Table 2 shows calculations of a ratio (R) which is calculated by dividing the ID by the OD. Table 2 includes R minimum values and R maximum values for each container size. Closures in accordance with the present disclosure may use any value shown by the ranges below in Table 2, any point within the ranges, or any combination of ranges falling within the range shown below in Table 2.

TABLE 2

| Ratios of ID to OD | | |
|---|---|---|
| Closure Size (AD) (mm) | R Max (ID/OD) | R Min (ID/OD) |
| 18 | 0.530 | 0.525 |
| 20 | 0.560 | 0.555 |
| 22 | 0.585 | 0.581 |
| 24 | 0.608 | 0.604 |
| 28 | 0.642 | 0.639 |
| 30 | 0.651 | 0.648 |
| 33 | 0.678 | 0.676 |
| 35 | 0.696 | 0.693 |
| 38 | 0.713 | 0.711 |
| 40 | 0.728 | 0.726 |
| 43 | 0.737 | 0.735 |
| 45 | 0.751 | 0.746 |
| 48 | 0.761 | 0.760 |
| 51 | 0.771 | 0.769 |
| 53 | 0.780 | 0.778 |
| 58 | 0.792 | 0.791 |

TABLE 2-continued

| Ratios of ID to OD | | |
|---|---|---|
| Closure Size (AD) (mm) | R Max (ID/OD) | R Min (ID/OD) |
| 60 | 0.801 | 0.800 |
| 63 | 0.809 | 0.808 |
| 66 | 0.816 | 0.816 |
| 70 | 0.825 | 0.825 |
| 75 | 0.835 | 0.834 |
| 77 | 0.840 | 0.840 |
| 83 | 0.849 | 0.849 |
| 89 | 0.858 | 0.858 |
| 100 | 0.872 | 0.872 |
| 110 | 0.883 | 0.882 |
| 120 | 0.892 | 0.891 |

In one example, a closure in accordance with the present disclosure has a diameter (AD) of about 24 mm. In one example, the 24 mm closure has an inner diameter (ID) in a range of 0.8 in to about 0.9 in. In another example, the 24 mm closure has an inner diameter (ID) in a range of about 0.86 in to about 0.87 in. In another example, the 24 mm closure has an inner diameter (ID) in a range of about 0.857 in to about 0.871 in. In one example, the 24 mm closure has an outer diameter (OD) in a range of 1.4 in to about 1.5 in. In another example, the 24 mm closure has an outer diameter (OD) in a range of about 1.41 in to about 1.43 in. In another example, the 24 mm closure has an outer diameter (OD) in a range of about 1.419 in to about 1.433 in. In one example, the 24 mm closure has a ratio (R) of the ID to the OD of greater than 0.6. In another example, the 24 mm closure has a ratio (R) of the ID to the OD in a range of 0.60 to about 0.61. In another example, the 24 mm closure has a ratio (R) of the ID to the OD in a range of 0.604 to about 0.608.

In another example, a closure in accordance with the present disclosure has a diameter (AD) of about 28 mm. In one example, the 28 mm closure has an inner diameter (ID) in a range of 1.0 in to about 1.1 in. In another example, the 28 mm closure has an inner diameter (ID) in a range of about 1.00 in to about 1.01 in. In another example, the 28 mm closure has an inner diameter (ID) in a range of about 0.995 in to about 1.009 in. In one example, the 28 mm closure has an outer diameter (OD) in a range of 1.5 in to about 1.7 in. In another example, the 28 mm closure has an outer diameter (OD) in a range of about 1.56 in to about 1.57 in. In another example, the 28 mm closure has an outer diameter (OD) in a range of about 1.557 in to about 1.571 in. In one example, the 28 mm closure has a ratio (R) of the ID to the OD of greater than 0.6. In another example, the 28 mm closure has a ratio (R) of the ID to the OD in a range of 0.60 to about 0.65. In another example, the 28 mm closure has a ratio (R) of the ID to the OD in a range of 0.64 to about 0.65. In another example, the 28 mm closure has a ratio (R) of the ID to the OD in a range of 0.639 to about 0.642.

In another example, a closure in accordance with the present disclosure has a diameter (AD) of about 38 mm. In one example, the 38 mm closure has an inner diameter (ID) in a range of 1.3 in to about 1.4 in. In another example, the 38 mm closure has an inner diameter (ID) in a range of about 1.38 in to about 1.40 in. In another example, the 38 mm closure has an inner diameter (ID) in a range of about 1.383 in to about 1.397 in. In one example, the 38 mm closure has an outer diameter (OD) in a range of 1.9 in to about 2.0 in. In another example, the 38 mm closure has an outer diameter (OD) in a range of about 1.95 in to about 1.96 in. In another example, the 38 mm closure has an outer diameter (OD) in a range of about 1.945 in to about 1.959 in. In one example, the 38 mm closure has a ratio (R) of the ID to the OD of greater than 0.6. In another example, the 38 mm closure has a ratio (R) of the ID to the OD in a range of 0.69 to about 0.72. In another example, the 38 mm closure has a ratio (R) of the ID to the OD in a range of 0.71 to about 0.72. In another example, the 38 mm closure has a ratio (R) of the ID to the OD in a range of 0.711 to about 0.713.

In another example, a closure in accordance with the present disclosure has a diameter (AD) of about 45 mm. In one example, the 45 mm closure has an inner diameter (ID) in a range of 1.6 in to about 1.7 in. In another example, the 45 mm closure has an inner diameter (ID) in a range of about 1.65 in to about 1.69 in. In another example, the 45 mm closure has an inner diameter (ID) in a range of about 1.647 in to about 1.691 in. In one example, the 45 mm closure has an outer diameter (OD) in a range of 2.2 in to about 2.3 in. In another example, the 45 mm closure has an outer diameter (OD) in a range of about 2.21 in to about 2.25 in. In another example, the 45 mm closure has an outer diameter (OD) in a range of about 2.209 in to about 2.253 in. In one example, the 45 mm closure has a ratio (R) of the ID to the OD of greater than 0.6. In another example, the 45 mm closure has a ratio (R) of the ID to the OD in a range of 0.73 to about 0.76. In another example, the 45 mm closure has a ratio (R) of the ID to the OD in a range of 0.74 to about 0.76. In another example, the 45 mm closure has a ratio (R) of the ID to the OD in a range of 0.746 to about 0.751.

In another example, a closure in accordance with the present disclosure has a diameter (AD) of about 45 mm. In one example, the 45 mm closure has an inner diameter (ID) in a range of 1.6 in to about 1.7 in. In another example, the 45 mm closure has an inner diameter (ID) in a range of about 1.65 in to about 1.69 in. In another example, the 45 mm closure has an inner diameter (ID) in a range of about 1.647 in to about 1.691 in. In one example, the 45 mm closure has an outer diameter (OD) in a range of 2.2 in to about 2.3 in. In another example, the 45 mm closure has an outer diameter (OD) in a range of about 2.21 in to about 2.25 in. In another example, the 45 mm closure has an outer diameter (OD) in a range of about 2.209 in to about 2.253 in. In one example, the 45 mm closure has a ratio (R) of the ID to the OD of greater than 0.6. In another example, the 45 mm closure has a ratio (R) of the ID to the OD in a range of 0.73 to about 0.76. In another example, the 45 mm closure has a ratio (R) of the ID to the OD in a range of 0.74 to about 0.76. In another example, the 45 mm closure has a ratio (R) of the ID to the OD in a range of 0.746 to about 0.751.

In another example, a closure in accordance with the present disclosure has a diameter (AD) of about 53 mm. In one example, the 53 mm closure has an inner diameter (ID) in a range of 1.9 in to about 2.1 in. In another example, the 53 mm closure has an inner diameter (ID) in a range of about 1.97 in to about 1.99 in. In another example, the 53 mm closure has an inner diameter (ID) in a range of about 1.974 in to about 1.988 in. In one example, the 53 mm closure has an outer diameter (OD) in a range of 2.4 in to about 2.6 in. In another example, the 53 mm closure has an outer diameter (OD) in a range of about 2.54 in to about 2.55 in. In another example, the 53 mm closure has an outer diameter (OD) in a range of about 2.536 in to about 2.550 in. In one example, the 53 mm closure has a ratio (R) of the ID to the OD of greater than 0.6. In another example, the 53 mm closure has a ratio (R) of the ID to the OD in a range of 0.76 to about 0.79. In another example, the 53 mm closure has a ratio (R) of the ID to the OD in a range of 0.77 to about 0.78. In another example, the 53 mm closure has a ratio (R) of the ID to the OD in a range of 0.778 to about 0.780.

Lid 50 is formed to include first and second passageways 27, 29 through lid 50 and at least partially defined by lid anchors 51, 52 and side walls 503, 504 as suggested in FIGS. 3 and 4. Tab-mover wall 501 is positioned to lie in passageway 27 such that slots 271, 272 are formed between first tab-mover wall 501 and side walls 503, 504. Tab-mover wall 502 is positioned to lie in passageway 29 such that slots 291, 292 are formed between second tab-mover wall 502 and side walls 503, 504. Tab-mover walls 501, 502 are configured to flex relative to top wall 500 within passageways 27, 29.

Removable closures in accordance with the present disclosure are configured to minimize a weight of the closure. In one example, weight is minimized as a result of forming the closure to include slots 271, 272, 291, 292. Removable closures in accordance with the present disclosure are also configured to reduce the overall outer diameter (OD) of the closure while maintaining the same inner diameter (ID) associated with filler neck 40. In one example, the outer diameter (OD) is reduced as a result of passageways 27, 29 allowing movement of tab-mover walls 501, 502 to the inner diameter (ID).

Figure 17:
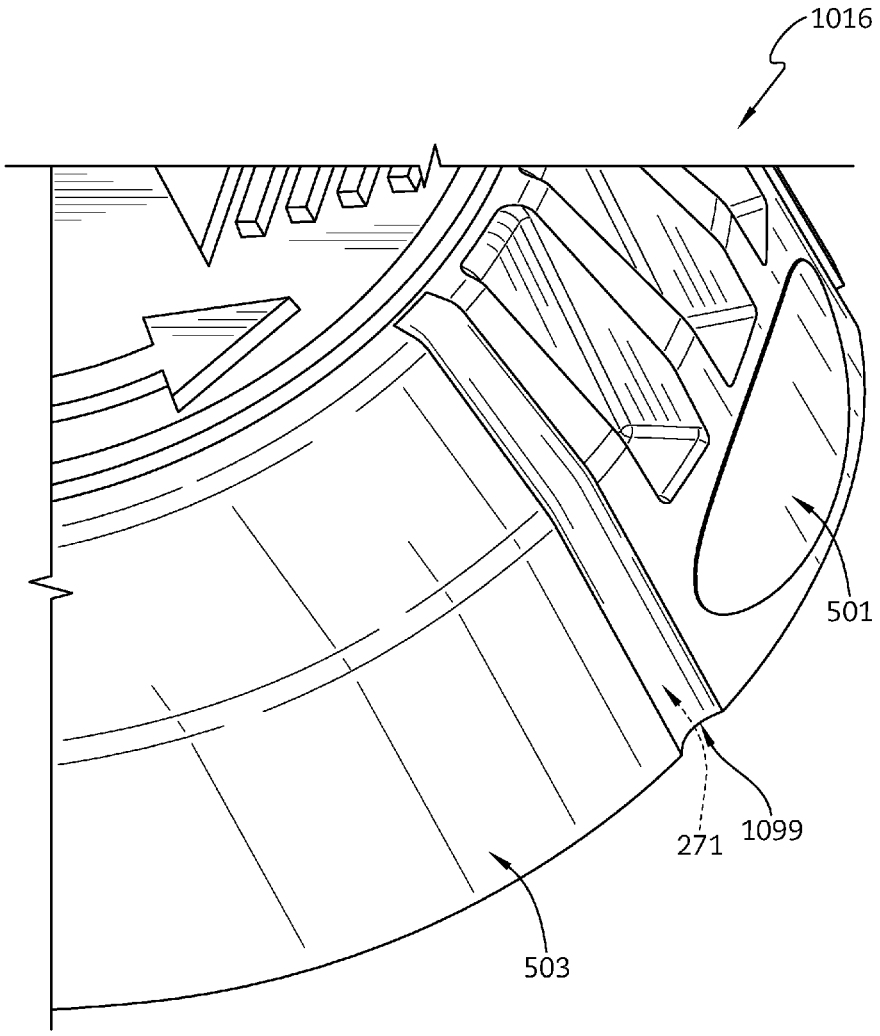
FIG. 17 is a partial perspective view of another embodiment of a closure in accordance with the present disclosure showing that the closure includes thin, deformable webs extending between side walls of the closure and tab-mover walls of the closure.

Another illustrative embodiment of a closure 1016 in accordance with the present disclosure for use with container 12 is illustrated in FIG. 17. Closure 1016 is substantially similar to closure 16 of FIGS. 1-4 except that thin, deformable webs 1099 extend across slots 271, 272, 291, 292 to connect tab-mover walls 501, 502 with side walls 503, 504, as illustratively shown by web 1099 extending across slot 271 between tab-mover wall 501 and side wall 503 in FIG. 17. Webs 1099 are configured to deform in a controlled manner to allow movement of tab-mover walls 501, 502 relative to side walls 503, 504. In one example, webs 1099 have a constant thickness along a length of the web that extends from the top wall of the closure downwardly toward the container 12. In another example, webs 1099 have a varying thickness along a length of the web that extends from the top wall of closure downwardly toward the container 12. The thickness may vary from thicker toward the top wall to thinner toward the container.

First lock tab 21 is coupled to first tab-mover wall 501 to move with tab-mover wall 501 within interior region 54 of lid 50 and may not be visible to an observer when closure 16 is mounted on container 12, if closure 16 or a portion thereof adjacent to first lock tab 21 is opaque, as suggested in FIG. 1. A second lock tab 22 is coupled to a second tab-mover wall 502 to move with second tab-mover wall 502 within interior region 54 of lid 50 as suggested in FIG. 2. In the illustrative embodiment, second lock tab 22 is substantially the same as first lock tab 21, and thus, the description of first lock tab 21 may also apply to second lock tab 22. Similarly, tab-mover wall 502 may be substantially the same as tab-mover wall 501, and thus, the description of tab-mover wall 501 also applies to tab-mover wall 502.

First tab blocker 28 is coupled to body 38 of container 12 in an illustrative embodiment of the present disclosure as suggested in FIG. 2. Tab blocker 28 is arranged to define an outer boundary of lock-tab pass-through channel 24. Tab blocker 28 includes a cam ramp 281 and a stop face 282. Tab blocker 28 is coupled to body 38 to lie in a stationary position to intercept and/or mate with first lock tab 21 as first lock tab 21 moves in or near lock-tab pass through channel 24 as suggested in FIGS. 8-12. In an illustrative embodiment, first tab blocker 28 and body 38 cooperate to form a monolithic, one piece, or unitary element as suggested in FIGS. 5 and 6.

In the illustrative embodiment, first lock tab 21 is formed to define an arcuate edge 211 and a mating edge 212 as suggested in FIGS. 3 and 4. In some embodiments, lock tab 21 is formed to define a beveled edge instead of arcuate edge 211 such that lock tab 21 assumes a wedge shape. Arcuate edge 211 of first lock tab 21 engages with cam ramp 281 to guide lock tab 21 into lock-tab pass through channel 24 during installation of closure 16 on container 12. First lock tab 21 is integrally formed with tab-mover wall 501 and is arranged to lie in spaced-apart radial relation to the tab-mover wall 501. First lock tab 21 is arranged to extend from an inner surface of tab-mover wall 501 in a direction along axis of rotation A, for example, generally parallel to tab-mover wall 501. First lock tab 21 is spaced radially inward from a portion of tab-mover wall 501 to define a gap G. In one example, tab blocker 28 passes through gap G during installation of closure 16 on container 12 as suggested in FIGS. 9-12.

Figure 8:
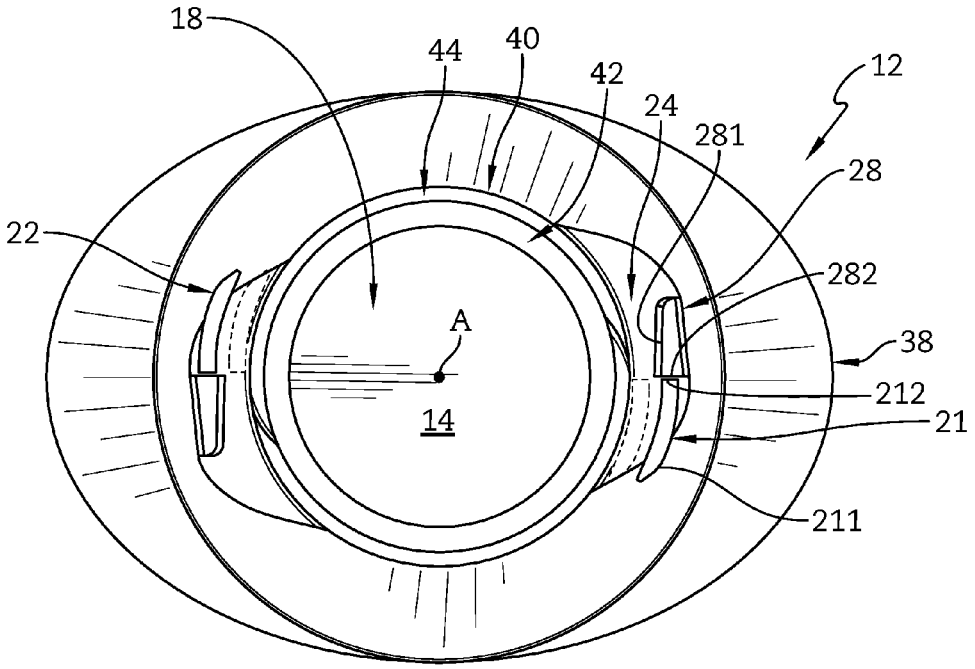
FIG. 8 is a top plan view of the container of FIG. 2 diagrammatically showing the lock tabs of the closure in the first position engaging the tab blockers to block rotation of the closure and suggesting that the lock tabs are separated from the tab blockers when in the second position so that rotation and removal of the closure is permitted.
Figure 9:
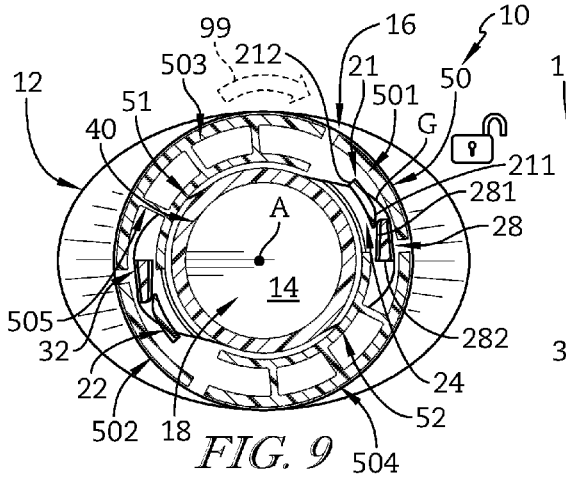
FIGS. 9-12 are a series of views showing movement of the lock tabs on the closure relative to the companion triangle-shaped tab blockers on the container during installation of the closure on the container and suggesting that rotation of the container increases as a double phantom (FIG. 9) arrow transitions to a double solid arrow (FIG. 12)
Figure 10:
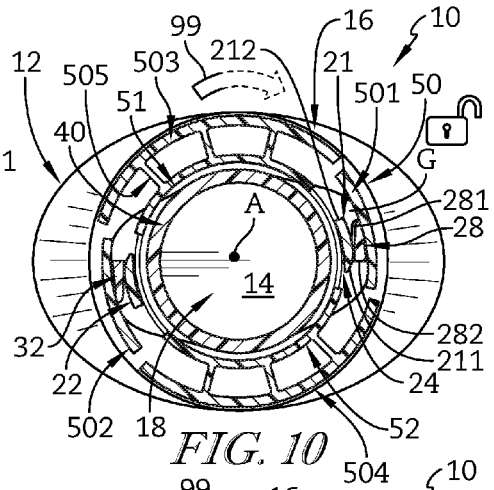
Figure 11:
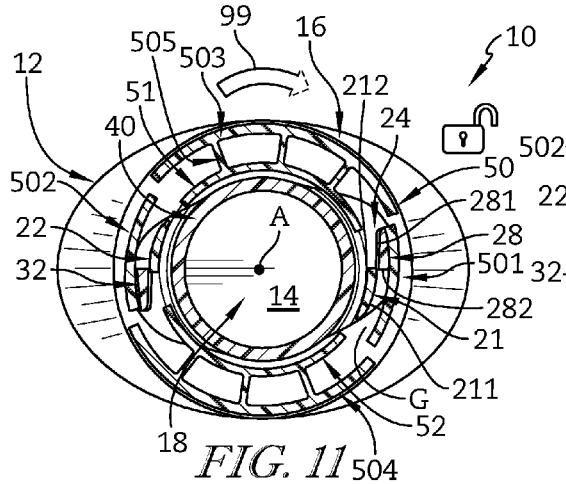
Figure 12:
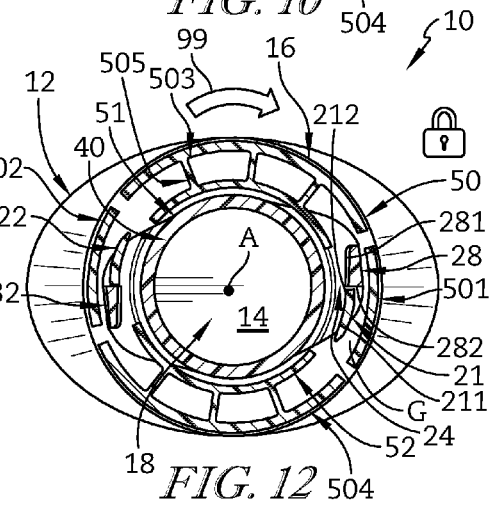

Cam ramp 281 is configured to provide means for contacting arcuate edge 211 of first lock tab 21 as first lock tab 21 moves through lock-tab pass through channel 24 during installation of closure 16 on container 12 and for yieldably biasing first lock tab 21 in a radially inward direction until first lock tab 21 clears tab blocker 28 as suggested in FIGS. 9 and 10. In some embodiments, only one of cam ramp 281 and arcuate edge 211 is used. Once cleared, the elastic tab-mover wall 501 snaps or moves first lock tab 21 in an opposite and/or radially outward direction to an un-deflected or equilibrium position to assume a locked position shown, for example, in FIGS. 11 and 12 in which mating edge 212 of first lock tab 21 lies in closely confronting relation to stop face 282 of tab blocker 28. In some embodiments, lock tab 21 is biased radially outward relative to tab blocker 28 during installation of closure 16 on container 12 and tab-mover wall 501 moves lock tab 21 radially inward after clearing tab blocker 28. Stop face 282 is configured to provide means for mating with mating edge 212 of first lock tab 21 when closure 16 is mounted on container 12 to block movement of closure 16 about axis A relative to container 12 in the counterclockwise closure-removal direction as suggested in FIG. 8. In another example, the description of lock tab 21 may be applicable to second lock tab 22. However, any suitable number of number lock tabs in accordance with the present disclosure may be used.

In the illustrative embodiment, first lock tab 21 extends from first tab-mover wall 501 as shown, for example, in FIGS. 3 and 4. Second lock tab 22 is integrally formed with tab-mover wall 502 and is arranged to lie in spaced-apart radial relation to the tab-mover wall 502. Second lock tab 22 is arranged to extend from an inner surface of tab-mover wall 502 in a direction along axis of rotation A, for example, generally parallel to tab-mover wall 502. Second lock tab 22 is configured to be the mirror image of first lock tab 21. Second lock tab 22 mates and interacts with a second tab blocker 32 coupled to body 38 of container 12 as suggested in FIGS. 2 and 8 in the same way that first lock tab 21 mates and interacts with first tab blocker 28. In the illustrated embodiment, second lock tab 22 and second tab blocker 32 are included in child-resistant closure-release control mechanism 20 and function in a manner suggested in FIGS. 7-14 to control release of closure 16 from companion container 12.

Figure 6:
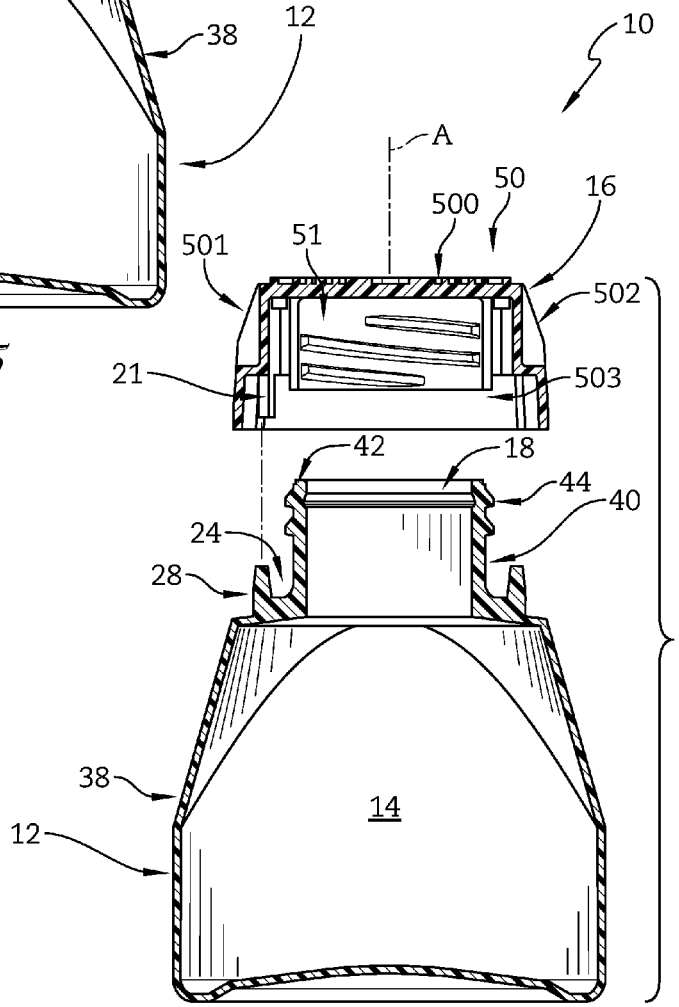
FIG. 6 is a view similar to FIG. 5 showing the closure in spaced-apart relation above the container prior to attachment of the closure and suggesting that the second lock tab (shown on the left) is positioned at a similar radial distance from an axis of rotation of the closure as the second tab blocker.

A first lid anchor 51 is included in closure 16 and configured to provide means for mating with closure retainer 44 coupled to filler neck 40 as suggested in FIG. 2 to retain closure 16 in an installed position on container 12 in a manner suggested in FIGS. 5 and 6. In an illustrative embodiment, a second lid anchor 52 is included in closure 16 and configured to mate with closure retainer 44 in a similar fashion. It is within the scope of the present disclosure to use any suitable lid anchor mechanism to retain closure 16 in an installed position on container 12. In one illustrative embodiment, lid anchors 51, 52 are formed to include threads for mating with threads of closure retainer 44.

Installation of closure 16 on container 12 is shown, for example, in FIGS. 9-12. In operation, as closure 16 is rotated about axis A in the direction of arrow 99, arcuate edge 211 of first lock tab 21 contacts cam ramp 281 of tab blocker 28 as suggested in FIG. 9. Further rotation of closure 16 in the tightening direction, as suggested by arrow 99, causes arcuate edge of first lock tab 21 to slide along cam ramp 281 such that tab-mover wall 501 flexes or deflects toward axis A to move first lock tab 21 radially inward as suggested in FIGS. 10 and 11. As first lock tab 21 slides along cam ramp 281, tab blocker 28 passes into gap G of tab-mover wall 501. After first lock tab 21 has slid over cam ramp 281, tab-mover wall 501 snaps outward toward an un-deflected or equilibrium position, to which the tabs are normally biased as a result of inward deflection caused by the cam ramps creating an outward spring action in the inwardly deflected tabs. When in the un-deflected or equilibrium position, first lock tab 21 has moved radially outward to align mating edge 212 of lock tab 21 with stop face 282 of tab blocker 28 as suggested in FIG. 12. Engagement between mating edge 212 of lock tab 21 and stop face 282 of tab blocker 28, both of which are located along a similar radius from axis A, blocks reverse rotation of closure 16 relative to the container without manipulation of closure-release control mechanism 20.

Figure 7:
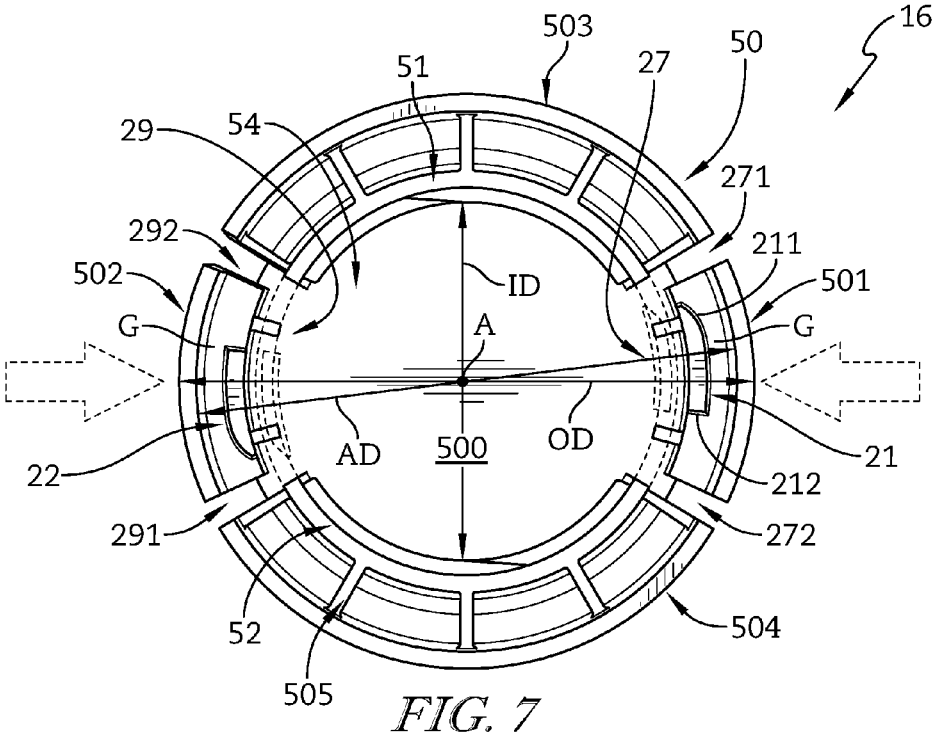
FIG. 7 is a bottom plan view of the closure of FIG. 2 showing the lock tabs in a first position and suggesting that a squeezing force (phantom double arrow) applied by an adult to the tab-mover walls flexes the tab-mover walls inward to move the lock tabs toward the axis of rotation through the passageway to a second position at a similar radial distance as the lid anchors to separate the lock tabs from engagement with the tab blockers as suggested in FIG. 8.

First lock tab 21 is shown in a first radial position (also called a closure-retaining position) when closure 16 is fully mounted onto container 12, in FIGS. 7 and 8. The squeezing force applied by an adult to tab-mover wall 501, as suggested by the phantom double arrow in FIG. 7, flexes tab-mover wall 501 radially inward to move first lock tab 21 toward axis of rotation A into passageway 27 to a second radial position, shown in phantom, at a similar radial distance from axis A as lid anchors 51, 52 to remove first lock tab 21 from engagement with tab blocker 28 as suggested in FIG. 8. In the second radial position, or closure-releasing position when an adult seeks to remove closure 16 from container 12, first lock tab 21 is able to travel back through lock-tab pass through channel 24 to allow removal of closure 16 from container 12.

Removal of closure 16 from container 12 is shown, for example, in FIGS. 13 and 14. A user applying squeezing forces (represented by opposing arrows) to tab-mover walls 501, 502 moves each of first and second lock tabs 21, 22 radially inwardly to cause each of those lock tabs 21, 22 to separate from their companion tab blockers 28, 32 to free closure 16 so it can be rotated in a counterclockwise closure-removal direction relative to container 12. Counterclockwise rotation of closure 16 relative to container 12 in the closure-removal direction removes closure 16 from container 12 to allow access through open mouth 18 to product-receiving chamber 14.

Separation of tab-mover walls 501, 502 from side walls 503, 504 by slots 271, 272, 291, 292 blocks first lock tab 21 from moving in a radially outward direction away from axis of rotation A to separate from tab blocker 28 during an unauthorized attempt to remove closure 16 from container 12 by application of a squeezing force to side walls 503, 504. Squeezing side walls 503, 504 does not move first lock tab 21 from the closure-retaining position shown in FIG. 13 in the radially outward direction to assume a radially outwardly displaced position unmated from tab blocker 28 (and located outside of lock-tab pass through channel 24 and inside interior region 54 of lid 50). As such, closure 16 is still blocked from rotation relative to container 12 about axis of rotation A in the closure-removal direction even when a squeezing force is applied to side walls 504, 504 because first lock tab 21 remains mated with tab blocker 28. The slots 271, 272, 291, 292 also minimize deformation of closure 16. Minimizing deformation allows closure 16 to be formed in a round shape instead of an oval-like shape where deformation of the closure is used to move the lock tabs. In some embodiments, lock tabs 21, 22 are of different construction. In some embodiments, lock tab-mover walls 501, 502 are of different construction.

The canister of the present disclosure provides for a child-resistant canister that maximizes filling speed. Filling speed may be influenced, in part, by an Inner Diameter (ID) of a filler neck included in a container of the canister. Filling speed may be improved when the ID of the filler neck is maximized. One example of a suitable ID is about 0.728 inches. However, other suitable ID's may be used where filling speed is not adversely impacted, such as from about 0.6 inches or greater, or as otherwise desired. The ID of the filler neck may also be defined by first and second lid anchors 51, 52 of closure 16 as they may correspond in size with rim 42 of container 12 to allow engagement of first and second lid anchors 51, 52 with closure retainer 44.

The canister of the present disclosure also provides for a child-resistant canister that maximizes container height as the width or diameter can be minimized while defining a similar internal volume for product. Maximizing container height also maximizes height of an area suitable for a label, graphic, indicia, etc. to be applied to the container, if desired, without providing for a short and squatty appearance of the canister, which may be considered undesirable in some cases, for example, when smaller capacity canisters are used. Smaller capacity canisters may include, for example, 30 ml packages and other like-sized packages.

Short and squatty appearance of the canister may be minimized as a result of minimizing an Outside Diameter (OD1) of the closure in relation to an Outside Diameter of the Container (OD2) and maximizing label height. Side walls 503, 504 define Outside Diameter (OD1) of closure 16 as measured from a lower perimeter edge of side walls 503, 504 spaced apart from top wall 500. Outside Diameter (OD1) of the closure is minimized in part by first and second lid anchors 51, 52 being spaced apart circumferentially from one another to locate first and second lock tabs 21, 22 circumferentially therebetween eliminating a need for a radial clearance between lock tabs 21, 22 and an internal threaded wall used to mount closure 16 on container 12. Lock tabs 21, 22 are spaced-apart axially from axis of rotation A a distance sufficient to minimize OD1 without interfering with engagement of lid anchors 51, 52 with closure retainer 44.

The canister of the present disclosure provides for maximized filling speed while minimizing a short and squatty appearance of the canister. The canister of the present disclosure accomplishes this by maximizing the ID of the container while minimizing the OD1 of the closure. Thus, the competing interests of filling speed and appearance of the container are satisfied by the canister of the present disclosure. Passageways 27, 29 minimize a weight of closure 16 while allowing the OD1 of closure 16 to be minimized such that smaller bottle footprints can be used without overhang of closure 16. The minimized OD1 of closure 16 allows a radial distance of tab blockers 28, 32 to be minimized to maximize dimensional control of canister 10.

Minimizing OD1 of the closure also for maximized dimensional control during manufacturing as a result of lock tabs 21, 22 being moved closer to rotation axis A. Furthermore, minimizing OD1 provides for a smaller footprint of the canister and for a closure that does not extend beyond a perimeter of the container (e.g., no closure overhang).

The invention claimed is:

1. A child-resistant canister comprising a container formed to include a product-receiving chamber and a mouth opening into the product-receiving chamber, a closure configured to mount on the container to assume a closed position closing the mouth formed in the container when rotated relative to the container about an axis of rotation, the closure including a first lid anchor and a second lid anchor, the first and second lid anchors configured to engage with the container to retain the closure on the container, and a closure-release control mechanism comprising a lock tab coupled to the closure and a tab blocker coupled to the container and configured to mate with the lock tab upon movement of the lock tab to a closure-retaining position to block rotation of the closure relative to the container about the axis of rotation in a closure-removal direction to retain the closure on the container, wherein the closure is formed to include a passageway extending through the closure between the first and second lid anchors and configured to allow movement of the lock tab in a radially inward direction toward the axis of rotation from the closure-retaining position to a closure-releasing position where the lock tab is positioned at a similar radial distance from the axis of rotation as the first and second lid anchors to separate the lock tab from the tab blocker and allow removal of the closure from the container, wherein the first and second lid anchors are each formed to define at least one thread segment for engaging the container.

2. The canister of claim 1, wherein the closure further includes a top wall and a tab-mover wall coupled to the top wall, and wherein the first and second lid anchors are coupled to the top wall on opposing sides of the tab-mover wall such that the first and second lid anchors are spaced apart from one another to define the passageway.

3. The canister of claim 2, wherein the lock tab is coupled to the tab-mover wall and the tab-mover wall is configured to flex relative to the top wall to move the lock tab within the passageway.

4. The canister of claim 3, wherein the tab-mover wall is spaced apart from the first and second lid anchors to define slots therebetween.

5. The canister of claim 4, wherein the slot extends from the top wall to a bottom edge of the tab-mover wall.

6. The canister of claim 5, wherein the closure has an inner diameter, a relatively larger outer diameter, and the ratio of the inner diameter to the outer diameter is greater than about 0.6.

7. The canister of claim 3, wherein the tab-mover wall is connected to the first and second lid anchors by deformable webs.

8. The canister of claim 1, wherein the closure has an opening diameter of about 28 millimeters, an inner diameter, a relatively larger outer diameter, and the ratio of the inner diameter to the outer diameter is in a range of about 0.64 to about 0.65.

9. The canister of claim 1, wherein the lid anchors define an inner diameter of the closure and the lock tab is movable to a position radially inward of the inner diameter.

10. The canister of claim 9, wherein the closure has an opening diameter of about 45 millimeters, an inner diameter in a range of about 1.6 inches to about 1.7 inches, a relatively larger outer diameter, and the ratio of the inner diameter to the outer diameter is in a range of about 0.74 to about 0.76.

11. The canister of claim 1, wherein the closure is formed to define a beveled portion extending from the top wall and a substantially cylindrical portion extending from the beveled portion.

12. A child-resistant canister comprising a container formed to include a product-receiving chamber and a mouth opening into the product-receiving chamber, a closure configured to mount on the container to assume a closed position closing the mouth formed in the container when rotated relative to the container about an axis of rotation, the closure including a first lid anchor and a second lid anchor, the first and second lid anchors configured to engage with the container to retain the closure on the container, and a closure-release control mechanism comprising a lock tab coupled to the closure and a tab blocker coupled to the container and configured to mate with the lock tab upon movement of the lock tab to a closure-retaining position to block rotation of the closure relative to the container about the axis of rotation in a closure-removal direction to retain the closure on the container, wherein the closure is formed to include a passageway extending through the closure between the first and second lid anchors and configured to allow movement of the lock tab in a radially inward direction toward the axis of rotation from the closure-retaining position to a closure-releasing position where the lock tab is positioned at a similar radial distance from the axis of rotation as the first and second lid anchors to separate the lock tab from the tab blocker and allow removal of the closure from the container, further comprising a floating liner coupled to the closure and located between a top wall of the closure and the first and second lid anchors, wherein the first lid anchor is a thread segment having a first end located between the floating lid and the top wall and a second end opposite the first end located between the first end and floating lid.

13. The canister of claim 12, wherein the first end is spaced apart from the top wall to locate the floating lid therebetween and engage the floating lid to block movement of the floating downwardly away from the top wall toward container.

14. The canister of claim 13, wherein the container includes a filler neck formed to include the mouth, the filler neck having an outside diameter, and the floating lid having a diameter greater than the outside diameter of the filler neck.

15. The canister of claim 14, wherein the closure has an opening diameter of about 53 millimeters, an inner diameter in a range of about 1.9 inches to about 2.0 inches, a relatively larger outer diameter in a range of about 2.5 inches to about 2.6 inches, and the ratio of the inner diameter to the outer diameter is in a range of about 0.77 to about 0.78.

16. A child-resistant canister comprising a container formed to include a product-receiving chamber and a mouth opening into the product-receiving chamber, a closure configured to mount on the container to assume a closed position closing the mouth formed in the container when rotated relative to the container about an axis of rotation, the closure including a first lid anchor and a second lid anchor, the first and second lid anchors configured to engage with the container to retain the closure on the container, and a closure-release control mechanism comprising a lock tab coupled to the closure and a tab blocker coupled to the container and configured to mate with the lock tab upon movement of the lock tab to a closure-retaining position to block rotation of the closure relative to the container about the axis of rotation in a closure-removal direction to retain the closure on the container, wherein the closure is formed to include a passageway extending through the closure between the first and second lid anchors and configured to provide means for allowing movement of the lock tab in a radially inward direction toward the axis of rotation from the closure-retaining position to a closure-releasing position where the lock tab is positioned at a similar radial distance from the axis of rotation as the first and second lid anchors to separate the lock tab from the tab blocker and allow removal of the closure from the container, wherein the closure has an opening diameter of about 24 millimeters, an inner diameter in a range of about 0.86 inches to about 0.87 inches, a relatively larger outer diameter in a range of about 1.42 inches to about 1.43 inches, and the ratio of the inner diameter to the outer diameter is in a range of about 0.60 to about 0.61, and further comprising a floating liner coupled to the closure and located between a top wall of the closure and the first and second lid anchors, the first lid anchor is a thread segment having a first end located between the floating lid and the top wall and a second end opposite the first end located between the first end and floating lid, and the first end is spaced apart from the top wall to locate the floating lid therebetween and engage the floating lid to block movement of the floating downwardly away from the top wall toward container.

* * * * *